United States Patent [19]

Hooper

[11] Patent Number: 4,492,315

[45] Date of Patent: Jan. 8, 1985

[54] MAILING MACHINE CUT TAPE FEED MODULE

[75] Inventor: Clinton E. Hooper, Brookfield, Conn.

[73] Assignee: Pitney Bowes Inc., Stamford, Conn.

[21] Appl. No.: 421,698

[22] Filed: Sep. 22, 1982

[51] Int. Cl.[3] ..... B65H 3/06

[52] U.S. Cl. ..... 221/186; 221/198; 221/231; 271/114

[58] Field of Search ..... 221/37, 186, 190, 198, 221/231, 259; 271/114, 115, 116

[56] References Cited

U.S. PATENT DOCUMENTS 1,078,938 11/1913 Miller ..... 271/114

3,260,402 7/1966 Lareau et al. ..... 221/186 X

FOREIGN PATENT DOCUMENTS 551447 1/1958 Canada ..... 221/231

*Primary Examiner*—F. J. Bartuska

*Attorney, Agent, or Firm*—Lawrence E. Sklar; William D. Soltow, Jr.; Albert W. Scribner

[57] ABSTRACT

A cut tape feed module for use with a mailing machine. The module includes a stationary mounting and cassette support, a driven pinion rotatably mounted on the mounting and cassette support, a drive roller drivingly connected to the driven pinion, and a movable, cut tape cassette slidably mounted on the mounting and cassette support. The cassette includes a gear rack for driving engagement with the pinion and a biased backing plate for urging the cut tape against the drive roller. The downward movement of the cassette causes rotation of the drive roller which in turn effects separation of the forwardmost cut tape and dispensing thereof from the cassette.

6 Claims, 7 Drawing Figures

MAILING MACHINE CUT TAPE FEED MODULE

BACKGROUND OF THE INVENTION

The instant invention relates to mailing machines, and more particularly to a module for dispensing pieces of cut tape on which postage indicia are printed In modern mailing machines, it is known to provide a capability for dispensing tape as well as means for feeding envelopes for postage indicia to be printed thereon. In some machines, the tape is provided in roll form and is cut prior to being printed. Cutting of the tape requires elaborate cutting apparatus which increases the complexity and cost of the mailing machine. One approach to the problems associated with roll tape is to provide cut tape in the form of a stack which is dispensed seriatim.

Heretofore the use of cut tape has necessitated changes or additions to the basic mailing machine and an external drive system. The instant invention accordingly provides a cut tape dispensing module which is simple, self contained, requires no changes or additions to the basic mailing machine, and which uses a cassette as a prime mover and self contained drive unit, thus eliminating the need for an external drive system.

SUMMARY OF THE INVENTION

The instant invention provides a cut tape feed module for use with a mailing machine, which comprises a stationary mounting and cassette support, a driven pinion rotatably mounted on the mounting and cassette support, a drive roller drivingly connected to the driven pinion, and a movable, cut tape cassette slidably mounted on the mounting and cassette support. The cassette includes a gear rack for driving engagement with the pinion and a biased backing plate for urging the cut tape against the drive roller. The downward movement of the cassette causes rotation of the drive roller which in turn effects separation of the forwardmost cut tape and dispensing thereof from the cassette

DETAILED DESCRIPTION

Figure 1:
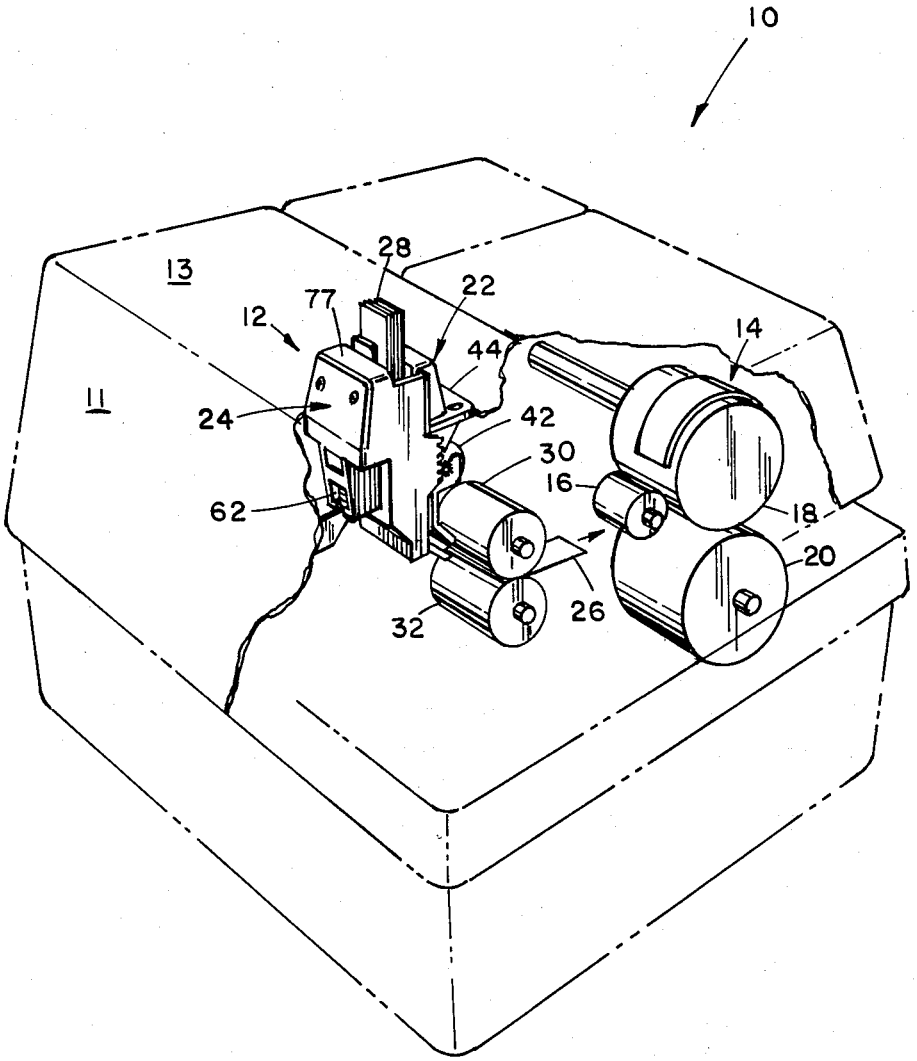
FIG. 1 is a perspective view of a mailing machine and a cut tape dispensing module according to the instant invention.

In describing the preferred embodiment of the instant invention, reference is made to the drawings, wherein there is seen in FIG. 1 a mailing machine generally designated 10 which provides housing walls 11 and 13 for mounting of the cut tape dispensing module 12 of the instant invention and a postage meter generally designated 14 having an inking roller 16, a print roller 18 and an impression roller 20.

Figure 2A:
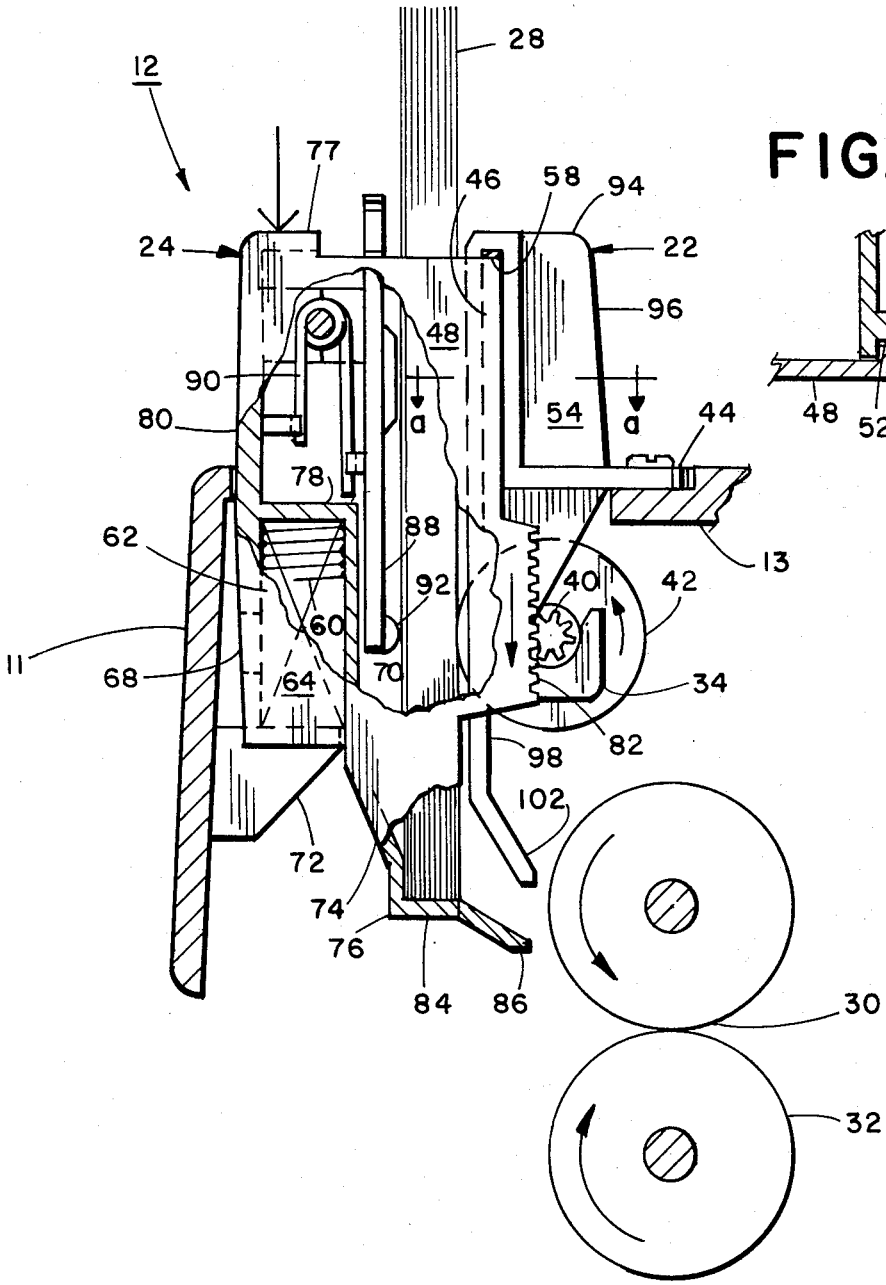
FIG. 2*a* is a sectional view taken on its plane indicated by the line a—a in FIG. 2.
Figure 2:
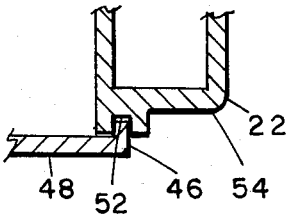
FIG. 2 is an enlarged, side elevational view, partially broken away, of the cut tape dispensing module seen in FIG. 1 in its home position.
Figure 3:
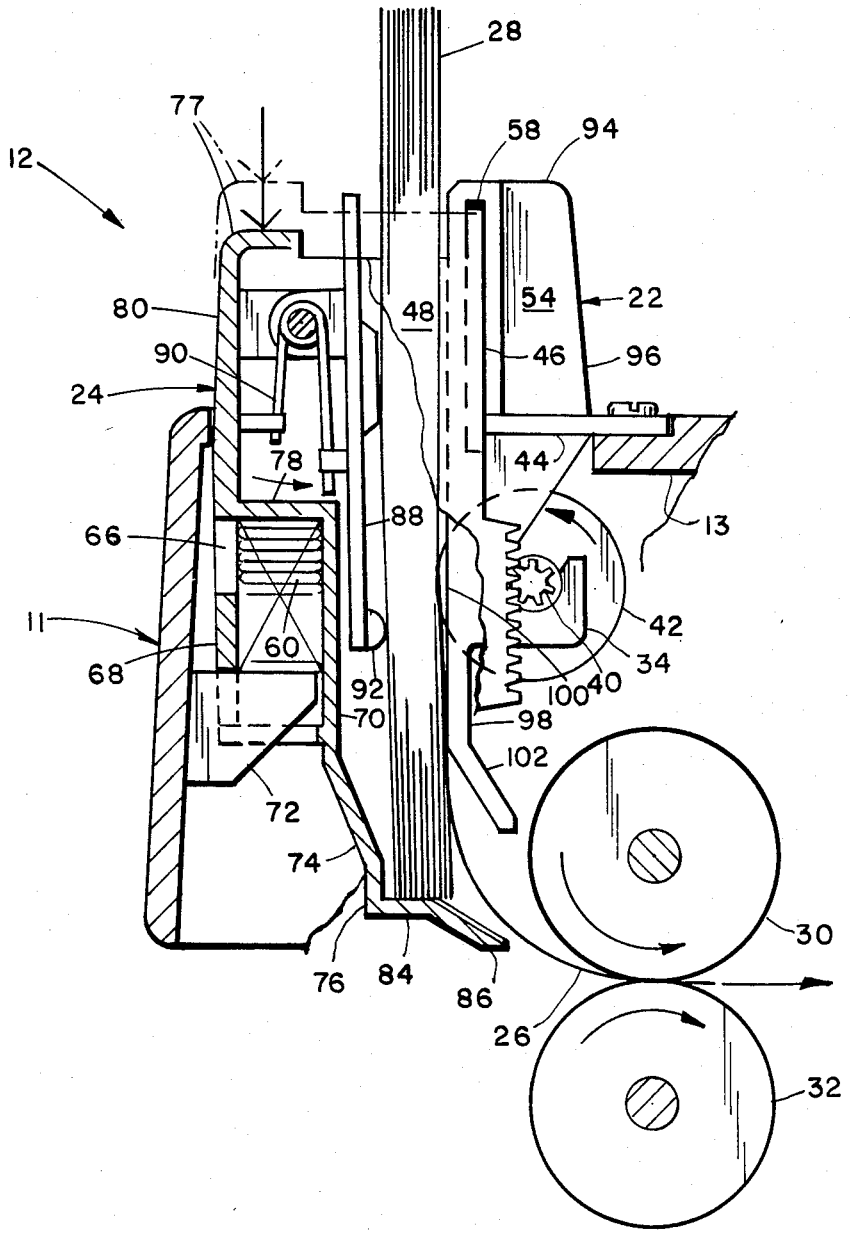
FIG. 3 is the same as FIG. 2 except it shows the cassette portion of the module at the bottom of the dispensing stroke ejecting a piece of cut tape.
Figure 4:
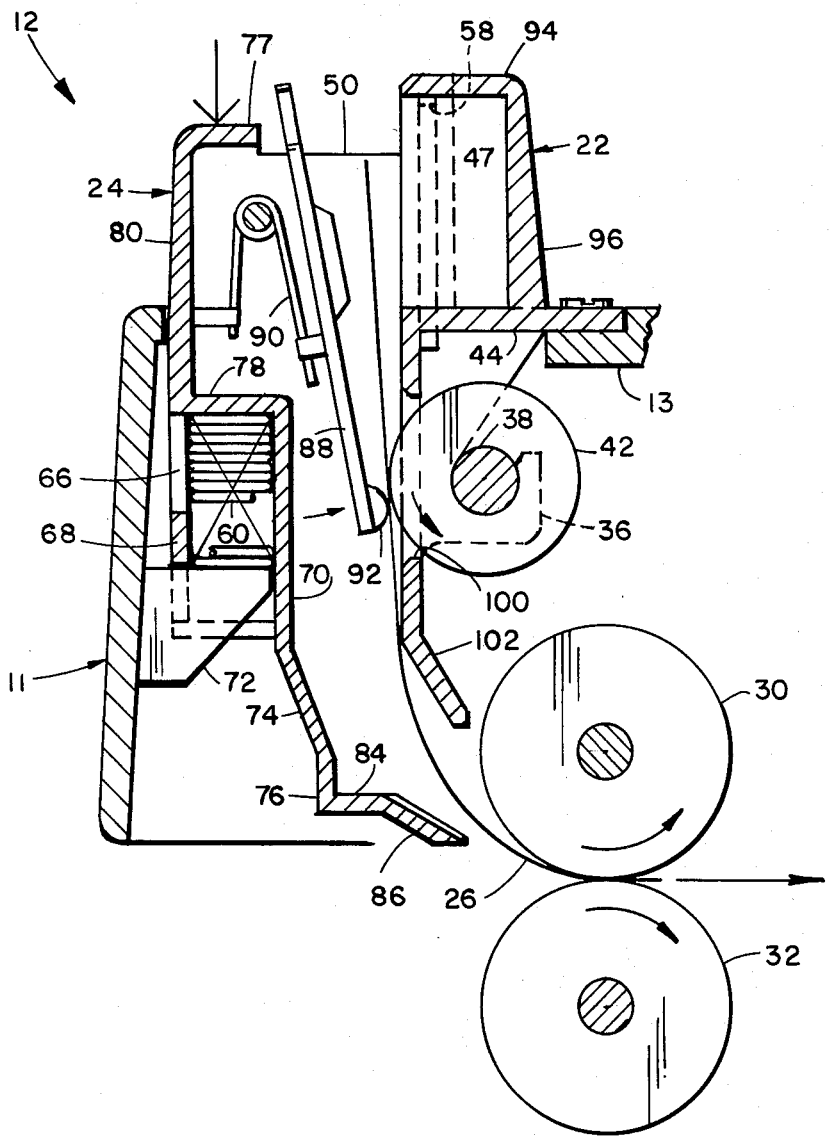
FIG. 4 is an enlarged, vertical sectional view of the cut tape dispensing module see in FIG. 1 except that all but the last piece of cut tape have been dispensed and the biased backing plate is in its forwardmost position.
Figure 5:
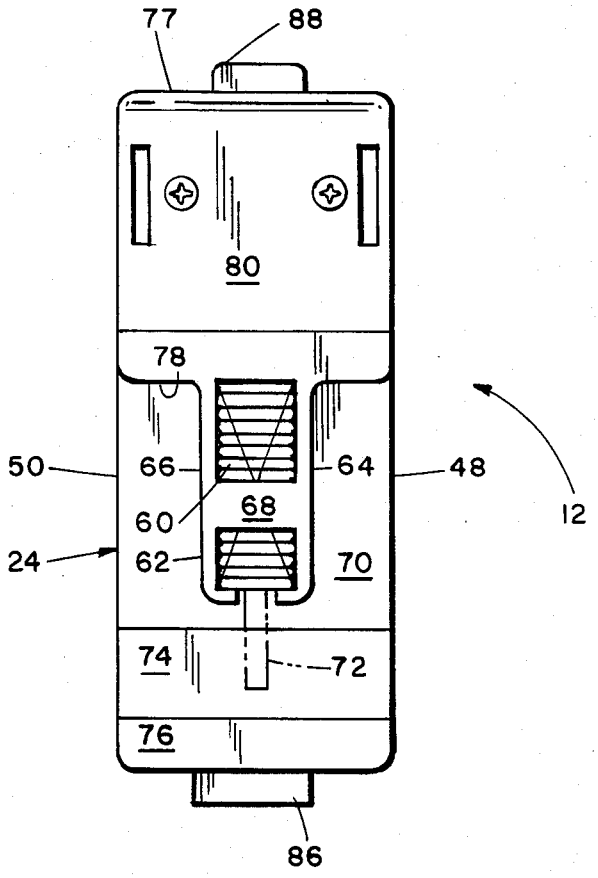
FIG. 5 is an enlarged, rear elevational view of the cut tape dispensing module seen in FIG. 1.
Figure 6:
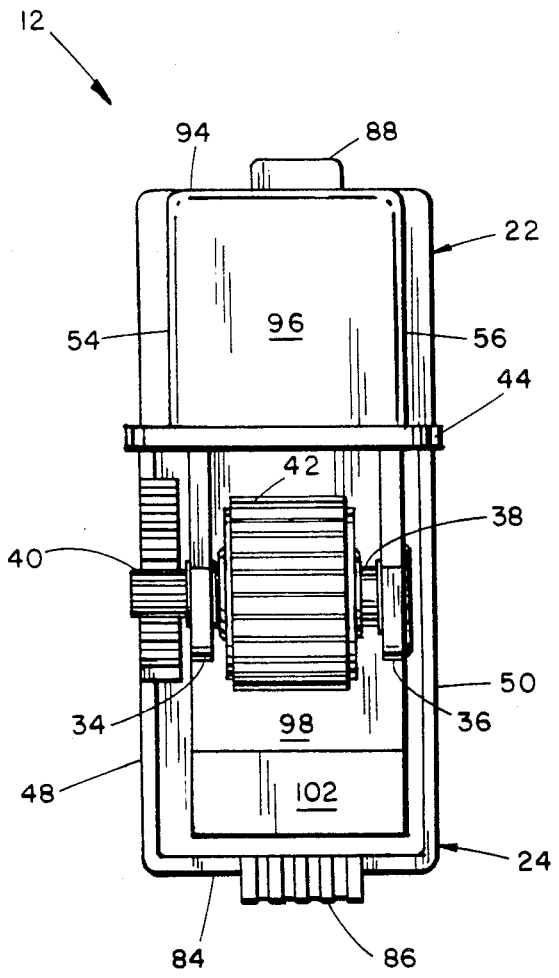
FIG. 6 is an enlarged, front elevational view of the cut tape dispensing module seen in FIG. 1.

Turning now to FIGS. 2–6, the cut tape dispensing module 12 includes a stationary mounting and cassette support 22 and a movable, cut tape cassette 24 slidably mounted on the support 22 for dispensing seriatim therefrom pieces of cut tape 26 from a stack 28 of cut tape toward a pair of drive rollers 30 and 32, which in turn feed the piece of cut tape 26 to the postage meter 14. The mounting and cassette support 22 includes a pair of flanges 34 and 36 for rotatably supporting a shaft 38 which has fixedly mounted thereon at one end a pinion 40. Also rotatably mounted on the shaft 38 is a drive roller 42, which as seen in FIGS. 2–4, is connected to the shaft 38 in such a way as to be driven by the pinion 40 only in the counterclockwise direction, typically by a conventional one-way clutch.

The cut tape dispensing module 12 is seated in the mailing machine 10 by means of a horizontal supporting wall 44 in the stationary mounting and cassette support 22 which is fixed to the mailing machine housing wall 13, so that the module 12 can be easily inserted and removed from the opening in the wall 13. The cut tape cassette 24 is slidably mounted on the stationary mounting and cassette support 22 by means of a pair of tongues 46 and 47 extending from each of the side walls 48 and 50 of the cassette 24 and which slide in the grooves 52 (only one is shown) situated in the side walls 54 and 56 of the stationary mounting and cassette support 22 (see FIG. 2*a*). The upper limit of travel of each of the tongues 46 and 47 in the grooves 52 is determined by a pair of rubber stops 58 located at the top of the grooves 52. A spring 60 is situated in a rectangular compartment generally designated 62 having side walls 64 and 66 (see FIG. 5) and a straight section 68 joining the two walls 64 and 66. The side walls 64 and 66 extend outwardly from a vertical, rear wall 70 of the cassette 24. The housing wall 11 of the mailing machine 10 includes a projection 72 against which the straight section 68 seats in the course of the downward travel of the cassette 24, thereby limiting the downward travel of the cassette 24.

The cassette 24, as previously noted, includes side walls 48 and 50 which are connected by a rear wall 70, as well as by an angled wall 74 situated beneath the rear wall 70, a vertical wall 76 situated beneath the angled wall 74, and an upper, horizontal wall 77. There is also a horizontal wall section 78 located above the rear wall 70 joining the side walls 48 and 50, and an upper vertical wall 80 located above the horizontal wall section 78 similarly joining the side walls 48 and 50. The fowardmost portion of the side wall 48 includes a rack 82 which drivingly engages the driven pinion 40 described hereinabove. Extending horizontally from the vertical wall 76 is a cut tape supporting wall 84, from which a guide 86 extends outwardly at an angle.

A backing plate 88 for the stack 28 of cut tape is biased forwardly by a spring 90 toward the drive roller 42, a protuberance 92 assuring greater frictional contact between the drive roller 42 and the piece of cut tape 26 to be dispensed by the dispensing module 12. The stationary mounting and cassette support 22 includes a top wall 94 and a front wall 96 which join the side walls 54 and 56 of the support 22. The horizontal supporting wall 44 extends outwardly from the bottom of the front wall 96 and side walls 54 and 56. Extending between the flanges 34 and 36 of the support 22 from the bottom of the horizontal supporting wall 44 to below the drive roller 42, is a vertical wall 98 which includes an opening 100 therein for admitting the drive roller 42. Extending from the vertical wall 98 at an angle is a guide 102 which cooperates with the guide 86 on the cassette 24 to form a chute for the pieces of cut tape 26 being dispensed.

In operation, a stack 28 of cut tape is inserted into the tape cassette 24 between the backing plate 88 and the drive roller 42, and when a piece of cut tape 26 is desired to be dispensed, the operator of the mailing machine 10 merely depresses the cassette 24 (see FIG. 3) by pushing downward on the upper, horizontal wall 77, which causes the gear rack 82 to move downward, which in turn rotates the pinion 40 counter-clockwise which in turn rotates the drive roller 42 counter-clockwise, thereby dispensing a single piece of cut tape 26 from the stack 28 outwardly between the guide 86 and the guide 102. The spring 90 continues to bias the backing plate 88 forwardly until all the pieces of cut tape 26 are dispensed and the backing plate 88 assumes the position seen in FIG. 4, at which time another stack 28 of cut tape should be inserted into the cassette 24.

When the cassette 24 is pushed downward, the gear rack 82, in a preferred embodiment of the instant invention, advances the drive roller 42 0.490 inch at its circumferential surface for each tooth on the rack 82. Expressed in different terms, a piece of tape 26 is advanced 5 units of length for a single unit of length of downward movement of the cassette 24, e.g. moving the cassette 24 downward 0.350 inch results in moving the piece of cut tape 26 a total of 1.750 inch, thereby demonstrating the mechanical advantage of the instant invention.

The spring 60 returns the cassette 24 to its home position seen in FIG. 2. In so doing, the rack 82 drives the pinion 40 in reverse, i.e. clockwise, which owing to the clutching arrangement between the pinion 40 and the drive roller 42, overruns the drive roller 42.

While the present invention has been described with the reference to the particular structure disclosed herein, it is not intended that it be limited to the specific details and this application is intended to cover such modifications or changes as may come within the purposes of the improvements or scope of the claims forming a part hereof.

What is claimed is:

1. A cut tape feed module for use with a mailing machine, comprising:

a stationary mounting and cassette support;

a driven pinion rotatably mounted on said mounting and cassette support;

a drive roller drivingly connected to said driven pinion; and a movable, cut tape cassette slidably mounted on said mounting and cassette support, said cassette having a gear rack for driving engagement with said pinion and a biased backing plate for urging the cut tape against the drive roller, wherein downward movement of the cassette causes rotation of the drive roller which in turn effects separation of the forwardmost cut tape and dispensing thereof from the cassette, the downward movement of the cassette and the rotation of the drive roller both being in the same direction as the movement of the cut tape being dispensed.

2. The feed module of claim 1, wherein the drive roller can be driven by the pinion in only one direction.

3. The feed module of claim 2, wherein the stationary mounting and cassette support includes a pair of grooves and the movable, cut tape cassette includes a pair of tongues which slidingly engage said grooves.

4. The feed module of claim 3, wherein the cassette support includes a pair of stops at the top of the grooves for limiting the upward travel of the tongues.

5. The feed module of claim 4, wherein the backing plate includes a protuberance at the bottom thereof for assuring greater frictional contact between the drive roller and the forwardmost cut tape.

6. The feed module of claim 4, wherein the bottom of the cassette support and the bottom of the cassette form a chute through which the cut tape is dispensed.

* * * * *